US005168658A

United States Patent [19]

Price

[11] Patent Number: 5,168,658

[45] Date of Patent: Dec. 8, 1992

[54] BELT GRINDING DEVICE

[75] Inventor: John L. Price, Mortdale, Australia

[73] Assignee: P A Products Pty. Limited, Mortdale, Australia

[21] Appl. No.: 721,992

[22] Filed: Jun. 27, 1991

[30] Foreign Application Priority Data

Jun. 28, 1990 [AU] Australia ..... PK0907
Dec. 20, 1990 [AU] Australia ..... PK4018

[51] Int. Cl.[5] ..... B24B 21/00; B24D 17/00

[52] U.S. Cl. ..... 51/148; 51/170 EB; 51/380; 51/383; 51/389

[58] Field of Search ..... 51/135 R, 148, 170 R, 51/170 EB, 168, 382, 383, 389, 380

[56] References Cited

U.S. PATENT DOCUMENTS 2,483,720 9/1949 Asbury ..... 51/148
2,538,044 1/1951 Ruehle ..... 51/148
2,726,493 12/1955 Young ..... 51/168
3,510,988 5/1970 Mason ..... 51/170
3,986,302 9/1976 Biardi ..... 51/168
4,197,680 4/1980 Althen ..... 51/380
4,561,217 12/1985 Steyskal ..... 51/168
4,977,712 12/1990 Fisher ..... 51/380
5,031,362 7/1991 Reiling ..... 51/170 EB

FOREIGN PATENT DOCUMENTS 208039 4/1957 Australia ..... 51/170 R

*Primary Examiner*—Bruce M. Kisliuk
*Assistant Examiner*—Bo Bounkong

[57] ABSTRACT

A belt grinding device for an endless abrasive belt which can be fitted to a power tool such as an angle grinder. The drive wheel 5 is centered on, and driven by, the drive shaft of the tool by way of a tapered insert or tapered nut engaging the drive shaft and a corresponding tapered centered hole of the drive wheel. The idler wheel 2 is axially located parallel to a square sectioned rigid structure 1 by a spring loaded telescopic portion and by a pair of sandwiched sliding plates 15 and 16.

15 Claims, 4 Drawing Sheets

BELT GRINDING DEVICE

BACKGROUND OF THE INVENTION

This invention relates to a belt grinding attachment adapted to be driven by a power tool, electric pneumatic or other, such as a disc or angle grinder.

Australian patent specifications AU-B-74741/81 and 74742/81 disclose a device generally of this type, though primarily adapted for attachment to bench grinders, such device fulfilling the necessary basic functions. Although such devices of the prior art work well, the novel features of the present invention greatly improve its adaptability so as to fit a multitude of power tools from various manufacturers without sacrificing its performance or adding complexity to design.

Devices of this general type include a driven pulley wheel and an idler pulley wheel being generally transversely aligned and parallel and being compressed apart so as to hold and drive an endless abrasive belt wrapped around the two pulley wheels. Of primary importance to good operation of these devices is the accuracy to which the rotational axes of the two pulley wheels are maintained relative to one another. Complicating the necessary structure is the fact that the two rotational axes must be adjustably skewed in order to adjust the correct tracking of each individual belt, and furthermore, they must be biased apart so as to provide necessary tension to the endless belt.

In the prior art these difficult constraints have been successfully met by providing a telescoping structure produced to very precise tolerances and extending between the driven pulley wheel and the idler wheel, see Australian patent publications noted above. The telescoping structure is spring-loaded in compression and adjustably rotated through some relatively small angle about its longitudinal axis at one end proximate the driven wheel. The inner and outer portions of the telescoping section are prevented from rotating relative to one another by a single sandwiched together sliding structure. The rotational adjustment at the driven pulley wheel end is effective to provide the necessary skewing adjustment in order to ensure correct tracking of each individual endless belt.

While this prior art device works perfectly well the necessary high precision of the components do add to the cost of the device. Thus there is room for improvement in providing a cheaper alternative which will not compromise the operational quality of the tool.

SUMMARY OF THE INVENTION

An object of the invention is to provide a belt grinding device for an endless abrasive belt including a drive wheel with a tapered central hole and a mating centering piece being one of a nut adapted to threadably engage a drive shaft of a power tool and having an external taper corresponding to the taper of the central hole, a compressible insert having a centre hole to slide in close fit along the drive shaft and an external taper corresponding to the taper of the central hole, or a stepped nut adapted to engage the drive shaft and having a step in one diametric face wherein the circular edge of the step will engage a circular line intermediate the surface of the taper of the central hole.

Another object of the present invention is to provide a belt grinding device for an endless abrasive belt comprising two wheels, one being a drive wheel and the other an idler wheel, held apart from one another, approximately parallel, and transversely aligned; a mounting structure adapted to be fixed to a power tool providing a rotational axis of the drive wheel during use of the machine; a rigid structure extending generally perpendicular from the rotational axis of the drive wheel and fixed to the mounting structure so as to be adjustably rotated about its longitudinal axis; a rod means extending from the rigid structure, sliding longitudinally relative thereto and being spring loaded so the rod means and rigid structure are pressed telescopically apart; the idler wheel being mounted on an idler bracket to rotate about an axis fixed perpendicularly to the rod means; and a pair of sandwiched sliding structures both providing substantially only sliding movement parallel to the longitudinal axis of the rigid structure and being mutually non-parallel and both being rigidly attached at one portion to the idler bracket and at another portion to the rigid structure.

BRIEF DESCRIPTION OF THE DRAWINGS

By way of example only, a preferred form of the invention will now be described with reference to the accompanying drawings in which.

DETAILED DESCRIPTION OF THE ILLUSTRATED EMBODIMENTS

Figure 1:
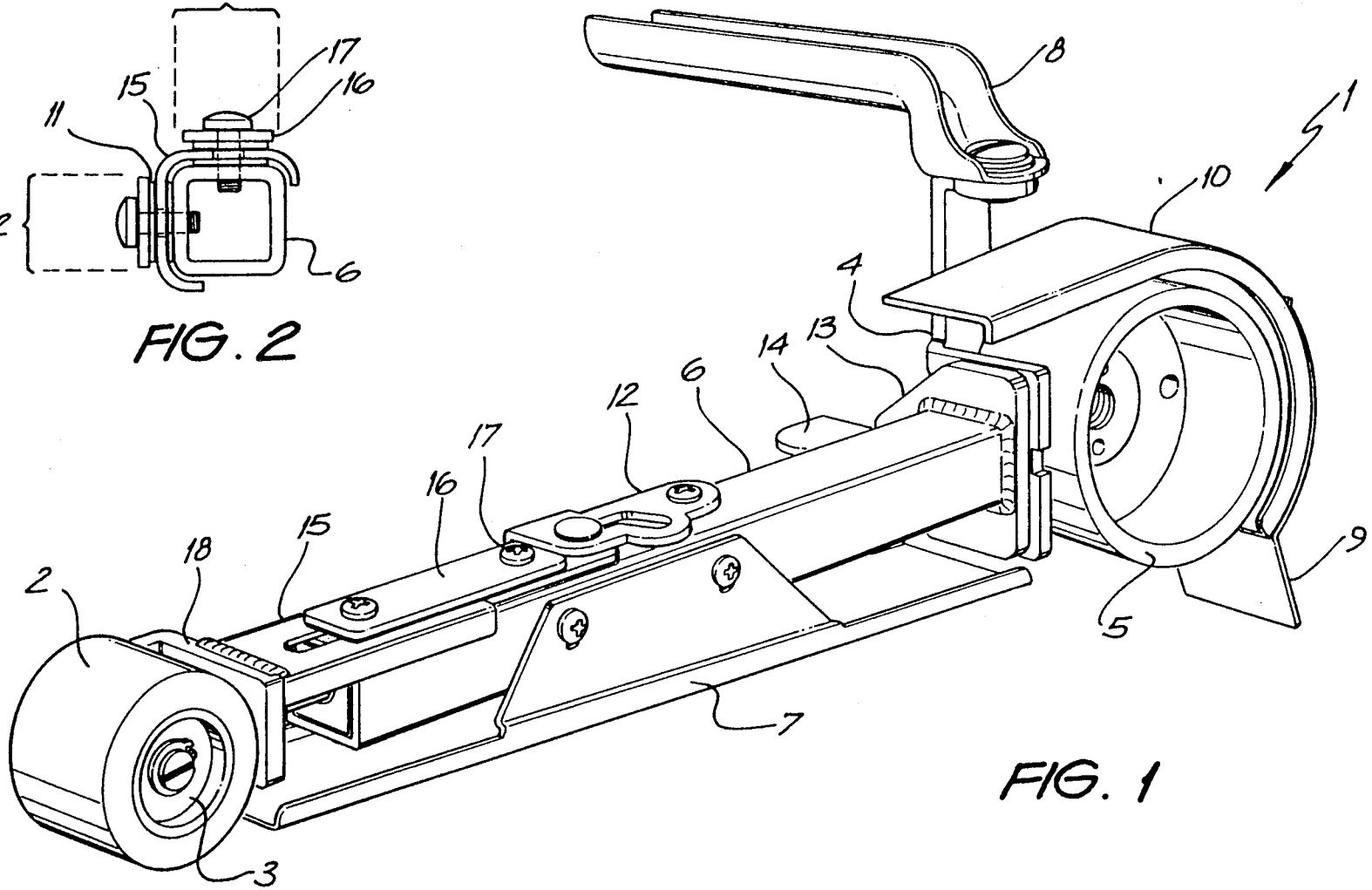
FIG. 1 is a perspective view of a belt grinder embodying the invention.

The tool is of a type comprising a generally elongate frame member 1 carrying an idler wheel 2 on bearings 3 at one end of the frame 1. At the opposite end of the frame 1 is a mounting structure 4 which also encloses a drive wheel 5. An endless abrasive belt may be routed about the two wheels 2 and 5 to be pressured by a platform 7 during abrasive operations.

In order to tension the belt the axis of idler wheel 2 is urged outwardly from the centre of frame 1 by way of an internal spring and push rod, to be described later in detail. A convenient latching device 12 is provided so as to lock the slide 15 in the compressed state while allowing for the changing of belts.

Integral with the mounting structure 4 is a main guard 10, and attached to the guard 10 is an adjustably positionable deflector plate 9.

Provided at the drive end of the frame 1 is an eccentric adjustor, the subject of patent specification AU-B-74741/81, for rotating the frame 1 and thus adjusting the tracking of the belt.

Briefly, this adjuster comprises an end plate 13 positioned flush against a portion of the mounting structure 4, and pinned so as to allow their relative rotation. The rotational positioning is adjustably fixed by moving a lever 14. This rotation provides an adjustment of the skew angle between the idler wheel 2 and the drive wheel 5, so as to adjust correct tracking of the abrasive belt during use of the tool.

Figure 4:
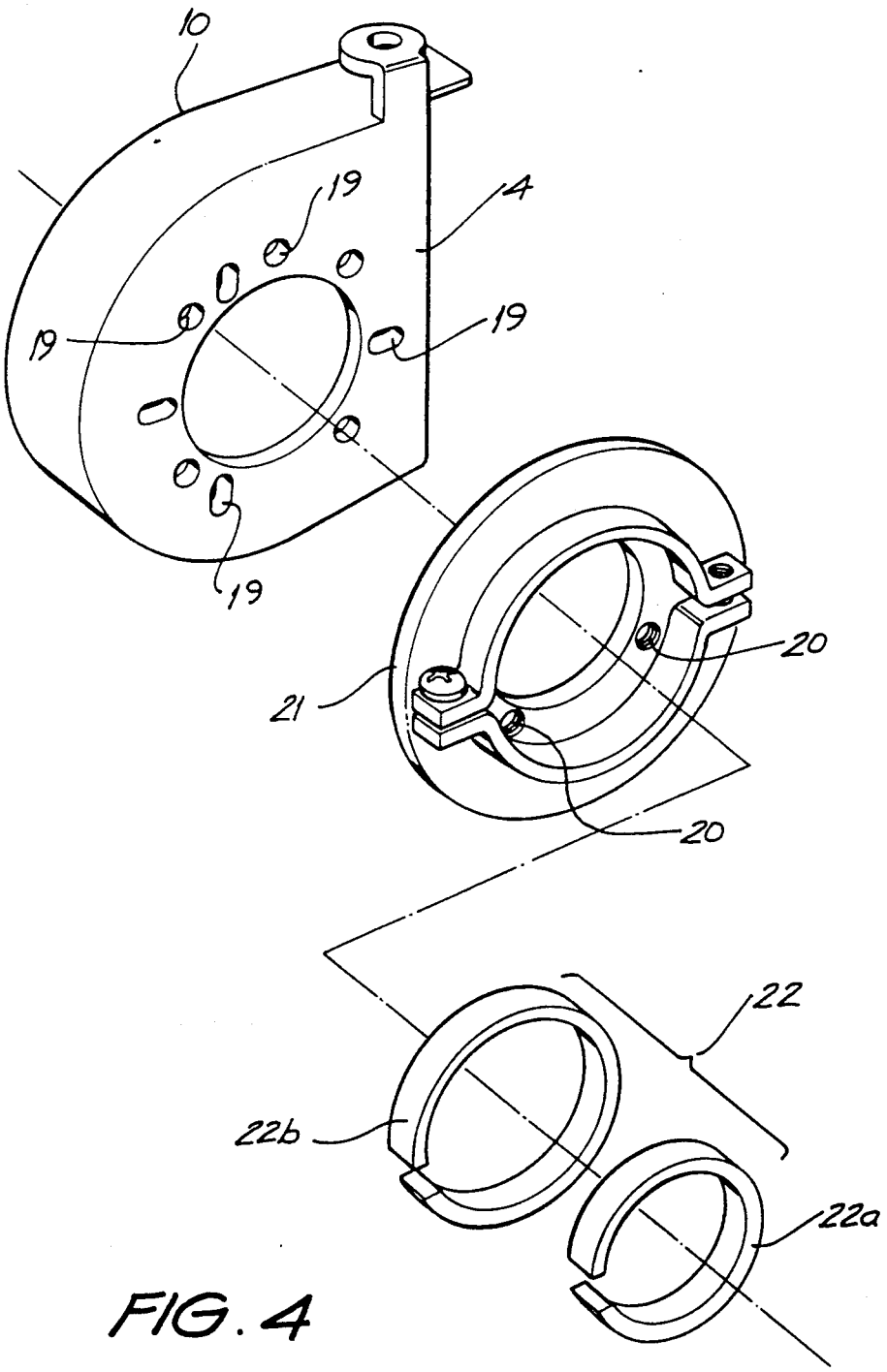
FIG. 4 is a view of a mounting structure of the device of FIG. 1 shown in a disassembled state.

Generally, the grinder is rigidly attached to a power tool by removing the standard guard from the power tool and utilizing the same attachment means on the power tool. These guards are usually attached in one of two ways, either by clamping on a shoulder of the power tool or by screwing into a side face of the power tool perpendicular to the drive shaft. The rear face of the attachment section 4 of the grinder, behind the drive wheel 5, includes a large number of holes 19, see FIG. 4, placed in a number of different positions so as to provide holes aligning with the guard attachment holes of the commonly available angle grinders. The provision of these holes 19 firstly allows for the rigid attachment, by way of screws, to the side face of the angle grinder tool, where its own guard is attached by a similar method. Secondly, the holes align with holes 20 of a clamp 21 being adapted to firmly engage the shoulder of those angle grinders where their shield is attached by a similar clamp. In various such grinders the shoulder is of varying diameters and ring sleeves 22 of varying thicknesses are therefore provided. The sleeves 22, or at least some of the sleeves 22*b*, fit snugly within the clamp 21 while others of the sleeves 22*a* may fit within a larger sleeve 22*b*, in order to accommodate very small diameter shoulders of the angle grinder, where such is the case. The sleeves 22 are stiff but diametrically compressible.

Figure 3:
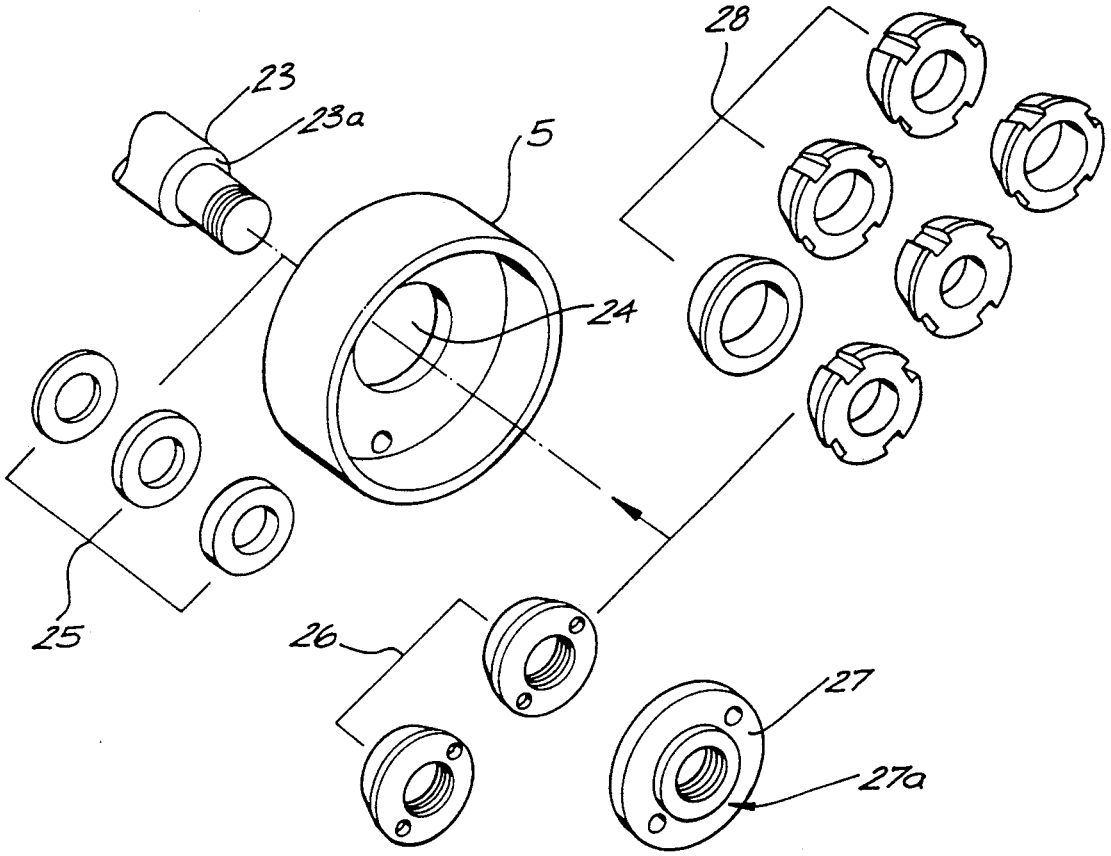
FIG. 3 is a view of a drive wheel of the device of FIG. 1 shown in a disassembled state;.

The structure of the drive wheel 5 is shown in more detail in FIG. 3, and in particular is shown the manner of attachment of the wheel 5 to a drive shaft 23 of a power tool. With, for example, an angle grinder, the drive shaft 23 will be of a different diameter, possess a different thread and be of a different protruding length according to each manufacturer's model. The wheel 5 has a centre hole 24 in the base of the wheel 5. The base is flush with the extreme rear of the wheel 5 which will be located proximate the power tool to which the belt grinder will be attached. The centre hole 24 includes a taper such that the hole 24 is divergent outwardly Washers 25, provided with the grinder in varying thicknesses of 2 mm (5/64"), 3 mm (⅛")and 4 mm (5/32") and various inside diameters to suit different spindles, are selected as required and installed on the drive shaft 23 so as to shim the wheel 5, when fitted, into correct alignment with the idler wheel 2. The correct alignment can be measured by the gap between wheel 5 and the back of the attachment section 4 after its attachment to the power tool.

The shaft 23 is inserted through the hole 24 and, depending upon the thread of shaft 23, either one of the tapered nuts 26, tapered compressible inserts 28 or the standard stepped nut 27 (supplied with some power tools), is attached over the shaft 23 to reside snugly, in the case of inserts 28, or to be threadedly engaged, in the case of nuts 26 and 27, upon the shaft 23, forcing the wheel 5 and washer(s) 25 back against a step 23*a* of the shaft 23 and centring the wheel 5 to very close tolerances about the shaft 23 by virtue of the mating tapered surfaces.

In the case of using the stepped nut 27, the nut is screwed onto shaft 23 with the stepped face 27*a* facing towards the tapered hole 24, the dimensions of the tapered hole 24 having been chosen such that the smaller diameter edge of the step 27*a* will firmly contact the tapering face of the tapered hole 24 and the diametric face of the stepped nut 27 is spaced a small distance from the adjacent face of the base of the wheel 5.

The tapered nuts 26, supplied with the grinding tool, are threaded to match common sized threaded shafts 23 of a number of commercially available angle grinders However, some angle grinders have a differently dimensioned thread and, by inserting the appropriately sized insert 28, the standard nut supplied with those other power tools can be used. The central holes of each of the inserts 28 differ in diametric size so as to suit the vast range of shaft diameters of various manufacturers' power tools, the sizes selected to give a close fit. The inserts 28 are compressible, though very stiff, and are squeezed in by the nut. Thus the arrangement centres the wheel 5 very accurately about the shaft 23 so that it will rotate with perfect concentricity. Any eccentricity in the drive wheel 5 will set up a vibration in the belt which will be transmitted to the idler wheel 2, and prevent the use of the idler wheel 2 as a grinding contact or pressure point. The use of the idler wheel 2 as a grinding point greatly increases the belt grinder's versatility by allowing grinding of otherwise inaccessible places such as inside corners or concave curves.

Figure 2:
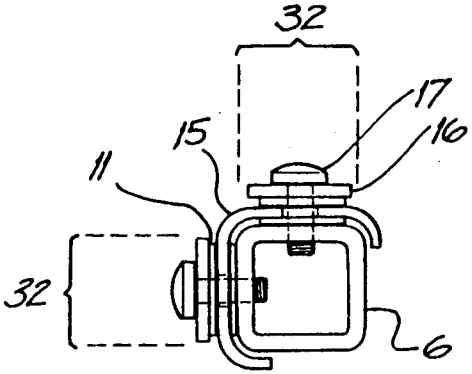
FIG. 2 is a view in cross section of a sandwich slide structure of the device of FIG. 1.
Figure 5:
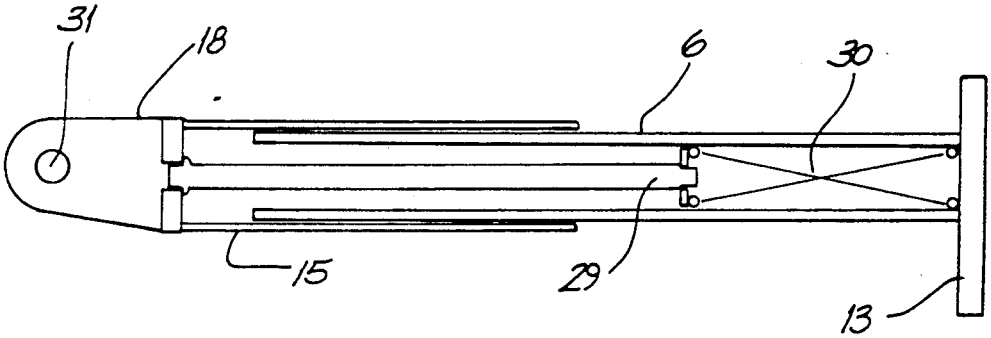
FIG. 5 is a view in cross section of a square hollow structure and co-operative slide of the device of FIG. 1.

FIG. 5 shows the internals of a generally elongate pressed steel square section rigid hollow structure which forms the square tube 6 attached at one end to the end plate 13. The plate 13 is generally perpendicular to the longitudinal axis of the rigid tube 6. Within the tube 6 is a rod 29 which is biased outwardly of the tube 6 by a spring 30. The angular shaped idler bracket 18 is held rigidly to the external end of the rod 29 and includes a hole 31 adapted for the attachment of an axle of an idler roller (not shown in FIG. 5, see FIG. 1) so that its axis of rotation will be substantially perpendicular to rod 29 The slide 15 is shown and its configuration is best seen by also considering FIG. 2.

In order to maintain the idler wheel 2 and driven pulley wheel 5 in position with high accuracy, the slide 15, and other structure, provides sandwich slide means 32 connected between the idler bracket 18 and the tube 6. In the end section view of FIG. 2 it will be seen how these two sandwich structures 32 are arranged in mutually perpendicular planes defined by adjacent sides of the square sectioned tube 6. Each sandwich 32 prevents the idler bracket 18 from moving in a transverse direction perpendicular to the plane of that respective sandwich 32.

Each of the structures 32 consist of two plate means and a side wall portion of the square tube 6 with interleaved teflon sheets 11. The two inner ones of the plate means being provided by the slide 15 which is rigid with the idler bracket 18. The other plate means being provided by outer individual plates 16 positioned substantially fixed relative to the tube 6 by way of pairs of screws 17. The screws 17 are an interference fit within the side wall of the tube 6. During assembly the screws 17 may be tightened right down and then turned back a predetermined amount so as to obtain a free sliding motion of slide 15 relative to the tube 6 and plate 16. The slide 15 is slotted, with screws 17 residing in the slots, so as to allow this sliding movement.

By virtue of the two sandwiched structures 32 being mutually perpendicular and parallel to the longitudinal axis of tube 6, the idler roller 2 is held to a highly precise degree in a plane fixed relative to the tube 6, but is slidable in that plane longitudinally of the tube 6 for belt tensioning. This arrangement provides the required high degree of accuracy without needing any precision machined components.

Conveniently the tube 6 can be made from a flat blank containing the seven necessary holes having been stamped out on a press. The seven holes are tapped simultaneously and a further three press operations will form the blank into a square tube which is far more accurate than stock square tube. This method eliminates costly cutting and deburring and multiple drilling and separate tapping operations. Of course, other production methods may be used.

Figure 6:
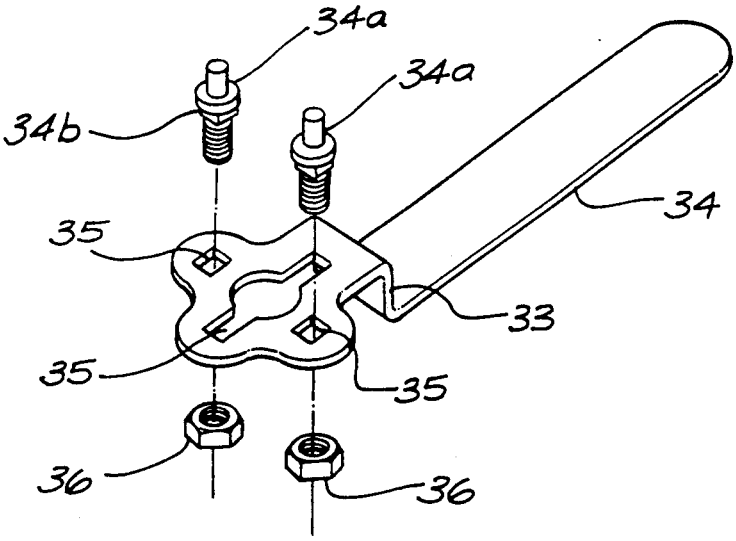
FIG. 6 is a view of a tool which is useful in attaching the device to a power tool.

FIG. 6 shows an adjustable pin spanner 34, which is supplied with the commercial embodiment of the belt grinding device, so as to be conveniently able to tighten any of the various nuts 26, 27, or the nuts supplied standard with many angle grinders, which include opposing pin holes for tightening. Standard pin spanners are generally flat and do not include the step 33 which enables proper tightening of the nuts when they are recessed well within the general cavity of the drive wheel 5. In order to accommodate varying diametric distances between the pin holes of such nuts, the pins 34*a* reside within slots 35 arranged in two opposing pairs in the head of the spanner 34. The pins include square bosses 34*b* so as to engage the slots with evenly distributed pressure. Nuts 37 hold the pins 34*a* in their appropriate position for a particular nut.

I claim:

1. A belt grinding device for an endless abrasive belt including a drive wheel with a tapered central hole and a mating centering piece being a compressible insert having a center hole to slide in close fit along a drive shaft of a co-operative power tool and an external taper corresponding to the taper of the central hole and a nut to threadably engage the drive shaft and compress the insert inwardly relative to the drive wheel so as to compress the central hole of the insert against the drive shaft and to compress the external taper against the central hole of the drive wheel and to accurately concentrically locate the drive wheel on the shaft.

2. A belt grinding device for an endless abrasive belt including a drive wheel with a central hole having a tapered surface, and a mating centering piece being a stepped nut adapted to engage a drive shaft of a co-operative power tool and having a step in one diametric face to provide a circular edge wherein the circular edge of the step will engage a circular line intermediate the tapered surface of the central hole to accurately concentrically locate the drive wheel on the shaft.

3. A belt grinding device for an endless abrasive belt including a drive wheel with a tapered central hole and being supplied with a plurality of mating centering pieces being, at least one of each of the group comprising at least one nut adapted to threadably engage a drive shaft of a power tool and having an external taper corresponding to the taper of the central hole and at least one compressible insert having a center hole to slide in close fit along the drive shaft of predetermined diameter and an external taper corresponding to the taper of the central hole to accurately concentrically locate the drive wheel on the shaft.

4. A belt grinding device of claim 3 wherein at least one compressible insert composes a plurality of compressible inserts, each having substantially the same external taper corresponding to the taper of the central hole, and each having respective center holes being of different diameters corresponding to respective drive shafts of different predetermined diameters.

5. A belt grinding device of claim 4 further provided with a plurality of washers each being of a number of different predetermined thickness, and each being one of a number of inside diameters corresponding to the respective drive shaft predetermined diameters.

6. A belt grinding device for an endless abrasive belt and being attached to a power tool including a drive shaft and a body, the device including a drive wheel with a tapered central hole and a mating centering piece having an external tape closely engaging the tapered central hole of the drive wheel and a central hole engaging the drive shaft, and the mating centering piece forcible pressing the drive wheel axially of the drive shaft toward the body of the power tool against a washer placed concentrically on the drive shaft between the drive wheel and a step in the drive shaft.

7. A belt grinding device of claim 6 wherein the mating centering piece is a compressible insert forcibly pressed inwardly against the drive wheel by a separate nut threadedly engaging the drive shaft.

8. A belt grinding device of claim 6 wherein the mating centering piece is an externally tapered nut threaded on the drive shaft.

9. A belt grinding device for an endless abrasive belt comprising two wheels, one being a drive wheel and the other an idler wheel, held axially apart from one another, approximately parallel, and transversely aligned; a mounting structure adapted to be fixed to a power tool providing a rotational axis of the drive wheel during use of the machine; a rigid structure extending perpendicular to the rotational axis of the drive wheel and rotatably fixed to the mounting structure so that the rigid structures is adjustably rotated about its longitudinal axis relative to the mounting structure; a rod means extending from the rigid structure, the rod means sliding longitudinally relative to the rigid structure and being spring loaded so the rod means and rigid structure are pressed telescopically apart; the idler wheel being mounted on an idler bracket, to rotate about an axis fixed perpendicuarly to the rod means, and a pair of sandwiched sliding structures, each sliding structure having respective first and second portions being held in a close parallel sliding relationship by adjustable screw means, each first portion being rigidly attached to the idler bracket and each second portion being rigidly attached to the rigid structure.

10. A belt grinding device for an endless abrasive belt comprising two wheels, one being a drive wheel and the other an idler wheel, held axially apart from one another, approximately parallel, and transversely aligned; a mounting structure adapted to be fixed to a power tool providing a rotational axis of the drive wheel during use of the machine; a rigid structure extending perpendicular to the rotational axis of the drive wheel and rotatably fixed to the mounting structure so that the rigid structure is adjustably rotated about its longitudinal axis relative to the mounting structure; a rod means extending from the rigid structure, the rod means sliding longitudinally relative to the rigid structure and being spring loaded so the rod means and rigid structure are pressed telescopically apart; the idler wheel being mounted on an idler bracket, to rotate about an axis fixed perpendicularly to the rod means, and a pair of sandwiched sliding structures, where each sandwiched sliding structure comprises a flat surface of the rigid structure, an outer plate means fixed relative to the surface of the rigid structure, an inner plate means positioned parallel and intermediate the outer plate means and the rigid structure and being rigidly attached relative to the idler bracket, and a pair of low friction laminates between the inner plate means and each of the outer plate means and the flat surface of the rigid structure.

11. A belt grinding device of claim 10, wherein each of the outer plates means is a flat surface fixed to the rigid structure by a pair of screws, the screws passing through longitudinally aligned slots of the inner plates means.

12. A belt grinding device of claim 11, wherein the rigid structure is substantially square in cross section, and the flat surfaces of the rigid structure are adjacent sides of the square sectioned rigid structure.

13. A belt grinding device of claim 12, wherein the rod means is a rod residing concentric with, and partially within the rigid structure, and being spring biased outwardly therefrom.

14. A belt grinding device of claim 13, wherein the idler bracket is substantially right angular to define a first surface to which the inner plate means are rigidly directly attached and to which the telescoping rod is attached, and an opposite surface to which an idler wheel axle is rigidly attached.

15. A belt grinding device of claim 14, wherein a right angular sectional slide defines the two inner plate means.

* * * * *